US005438191A

United States Patent [19]

Kimura et al.

[11] Patent Number: 5,438,191

[45] Date of Patent: Aug. 1, 1995

[54] PHOTOMULTIPLIER

[75] Inventors: Suenori Kimura; Nobuyuki Ohsugi; Toshiharu Totsuka, all of Hamamatsu, Japan

[73] Assignee: Hamamatsu Photonics K.K., Hamamatsu, Japan

[21] Appl. No.: 102,808

[22] Filed: Aug. 6, 1993

[30] Foreign Application Priority Data

Aug. 10, 1992 [JP] Japan ..... 4-212723

[51] Int. Cl.[6] ..... H01J 43/18; H01J 40/14

[52] U.S. Cl. ..... 250/207; 250/216; 250/228; 250/250

[58] Field of Search ..... 250/207, 216, 213, 250, 250/228

[56] References Cited

U.S. PATENT DOCUMENTS 3,567,948 3/1971 Oke et al. .
4,306,171 12/1981 Faulkner et al. .
4,937,506 6/1990 Kimura et al. ..... 250/207

FOREIGN PATENT DOCUMENTS 58-88685 5/1983 Japan .
2266287 10/1990 Japan .
881317 11/1961 United Kingdom .

*Primary Examiner*—William L. Sikes
*Assistant Examiner*—Fetsum Abraham
*Attorney, Agent, or Firm*—Cushman Darby & Cushman

[57] ABSTRACT

The present invention pertains to a photomultiplier of head-on type that has a transparent tubular glass bulb and a principal photocathode formed on the internal surface of a closed end of the glass bulb, that is, on the internal surface of a light entrance window. In addition, this photomultiplier has a side photocathode formed on the entire internal surface of side wall of the glass bulb in the region adjacent to the principal photocathode. A reflection film is formed on the outer surface of side wall of the glass bulb and opposes to the side photocathode. Some light entering the peripheral portion of the light entrance window of the glass bulb and traveling toward the outer surface of side wall is reflected inwardly by the reflection film and reaches the side photocathode, where the light is to be converted into photoelectrons. The photoelectrons are guided to the electron multiplying unit in glass bulb, where the photoelectrons are multiplied and detected by an anode.

13 Claims, 5 Drawing Sheets

PHOTOMULTIPLIER

BACKGROUND OF THE INVENTION

1. Field of the Invention

The present invention relates to a photomultiplier of the so-called head-on or end-on type, into which light to be detected is incident through a closed end of a tubular closed container.

2. Related Background Art

FIG. 1 shows a head-on type photomultiplier which is often conventionally used. This photomultiplier has a light entrance window 2 which is a closed end of a glass bulb 1 of a transparent tubular closed container and through which light L to be detected enters the container. The incident light L passing through the light entrance window 2 reaches a photocathode 3 formed inside the light entrance window 2, whereby photoelectrons are emitted. A focusing electrode 4 guides the emitted photoelectrons to an electron multiplying unit 5. The electron multiplying unit 5 as shown is comprised of a plurality of box-and-grid type dynodes 6 combined in multiple stages. The electron multiplying unit 5 successively multiplies the photoelectrons by the secondary emission effect, and the thus multiplied electrons are collected as output signal by an anode 7.

In the conventional photomultiplier as described, aluminum is vapor-deposited over an internal surface of a side wall 8 of the glass bulb 1 in order to maintain the potential of the photocathode 3. The aluminum vapor-deposited film 9 is connected with the photocathode 3 at a part thereof. The aluminum vapor-deposited film 9 is formed over the entire internal surface of side wall 8 within the region between the light entrance window 2 and the focusing electrode 4 to prevent light from the side from entering the glass bulb 1.

The existence of aluminum vapor-deposited film 9, however, causes a decrease in sensitivity of photomultiplier, because in addition to the incident light which passes into an effective area in the light entrance window 2, incident light L' is directed obliquely and outwardly at the periphery of effective area and therefore cannot be detected. As clearly shown in FIG. 2, a part of incident light L' passes obliquely at the periphery of light entrance window 2 and exists from the side wall 8 of glass bulb 1. The remainder is reflected by the external surface of side wall 8 towards the inside of the glass bulb 1, but is stopped from entering the inside by the aluminum vapor-deposited film 9.

A countermeasure against this problem may be use of a photomultiplier having a side photocathode 10 which is formed by extending the photocathode 3 to above the internal surface of side wall 8 of glass bulb 1, as shown in FIG. 3. Using the photomultiplier of such type, a part of light L' could go into the side photocathode 10 and be detected as electrons. It is, however, impossible that all light L' impinge on the side photocathode 10, and therefore a part thereof is inevitably lost out of the side wall 8. In addition, the photomultiplier of FIG. 3 also detects light L'' going toward the side of glass bulb 1, which hinders detection of only light coming into the front of light entrance window 2.

SUMMARY OF THE INVENTION

This and other objectives can be achieved according to the photomultiplier of the present invention. According to the present invention, the photomultiplier comprises a transparent tubular closed container with a photocathode formed on an internal surface at a closed end of the container. An electron multiplying unit is disposed in the closed container for multiplying electrons emitted from the photocathode when the photocathode receives light entering the closed end. The photomultiplier further comprises a focusing electrode located between the photocathode and the electron multiplying unit in the closed container. The focusing electrode has an aperture for focusing electrons emitted from the photocathode and for guiding the electrons to the electron multiplying unit. A side photocathode is formed on the internal surface so as to cover substantially the entire internal surface of the side wall of the closed container in a predetermined region adjacent to the photocathode. Finally, a reflection film is formed on an outer surface of the side wall of the closed container such that the reflection film is substantially opposed to the side photocathode and has a reflective surface on the closed container side.

The side photocathode extends from the peripheral edge of the photocathode to a certain level between the focusing electrode and the photocathode such that electrons emitted from the side photocathode are guided to the electron multiplying unit through the aperture of the focusing electrode.

Further, the reflection film extends at a predetermined length from the edge of outer surface of the side wall on the closed end side toward the other edge.

A preferable reflection film is one formed by winding a reflective tape with a reflective surface on its adhesive face round the outer surface of the side wall of closed container. Alternatively, the reflection film may be formed by vapor-depositing aluminum or an equivalent onto the outer surface of the side wall of closed container, or by coating the outer surface of the side wall of closed container with barium sulfate or an equivalent.

DESCRIPTION OF THE PREFERRED EMBODIMENTS

Figure 1:
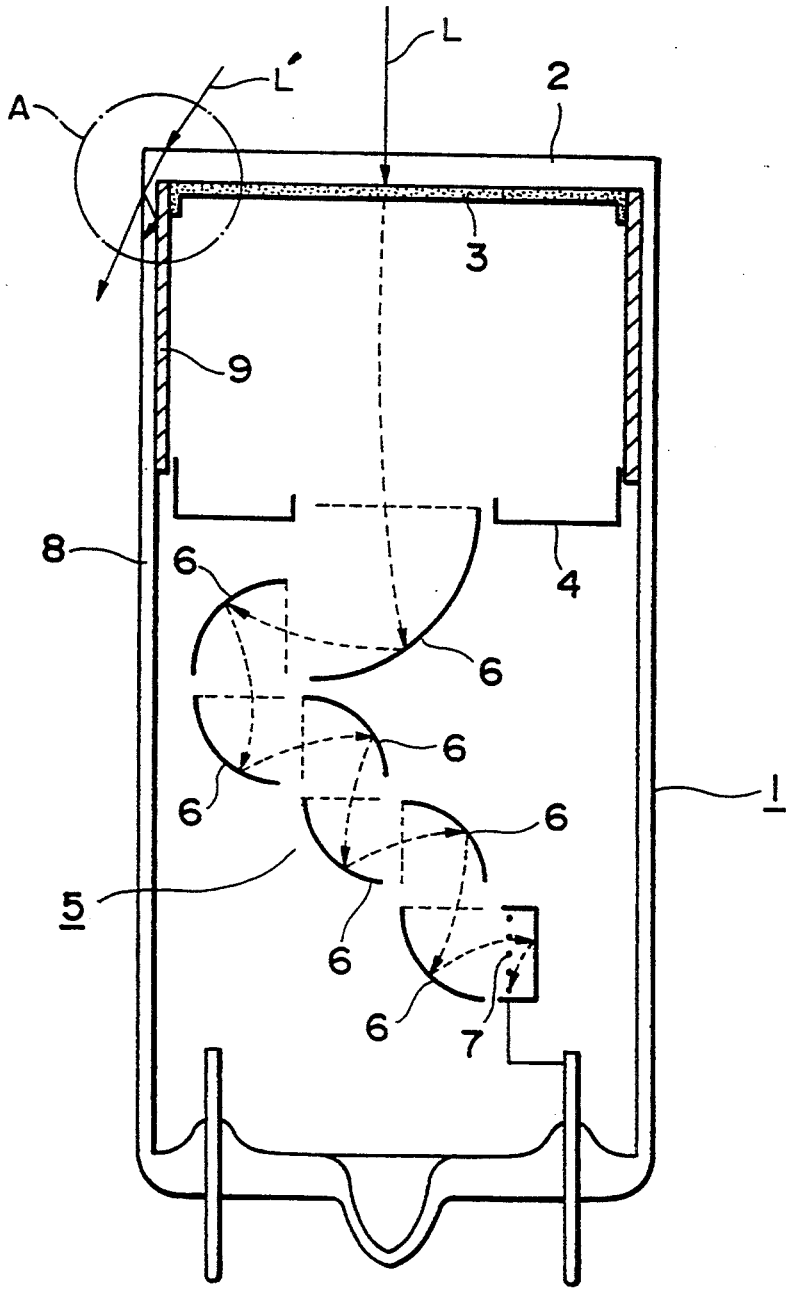
Fig. 1 (PRIOR ART)
FIG. 1 is an end elevation schematically, showing a photomultiplier which is conventionally often used.
Figure 2:
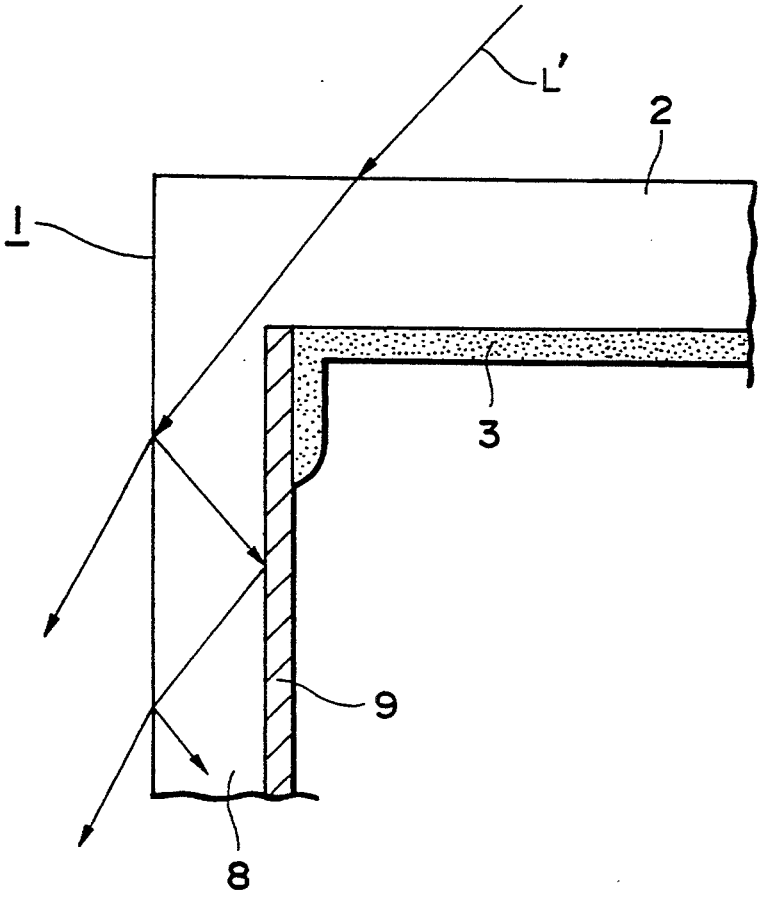
Fig. 2 (PRIOR ART)
FIG. 2 is an enlarged view showing the portion A in FIG. 1 as enlarged.

The preferred embodiments of the present invention will be described in detail with reference to the accompanying drawings. In the drawings same or corresponding portions are denoted by same numerals, and the term "upper" or "lower" in the following description refers to upper or lower in each drawing.

Figure 4:
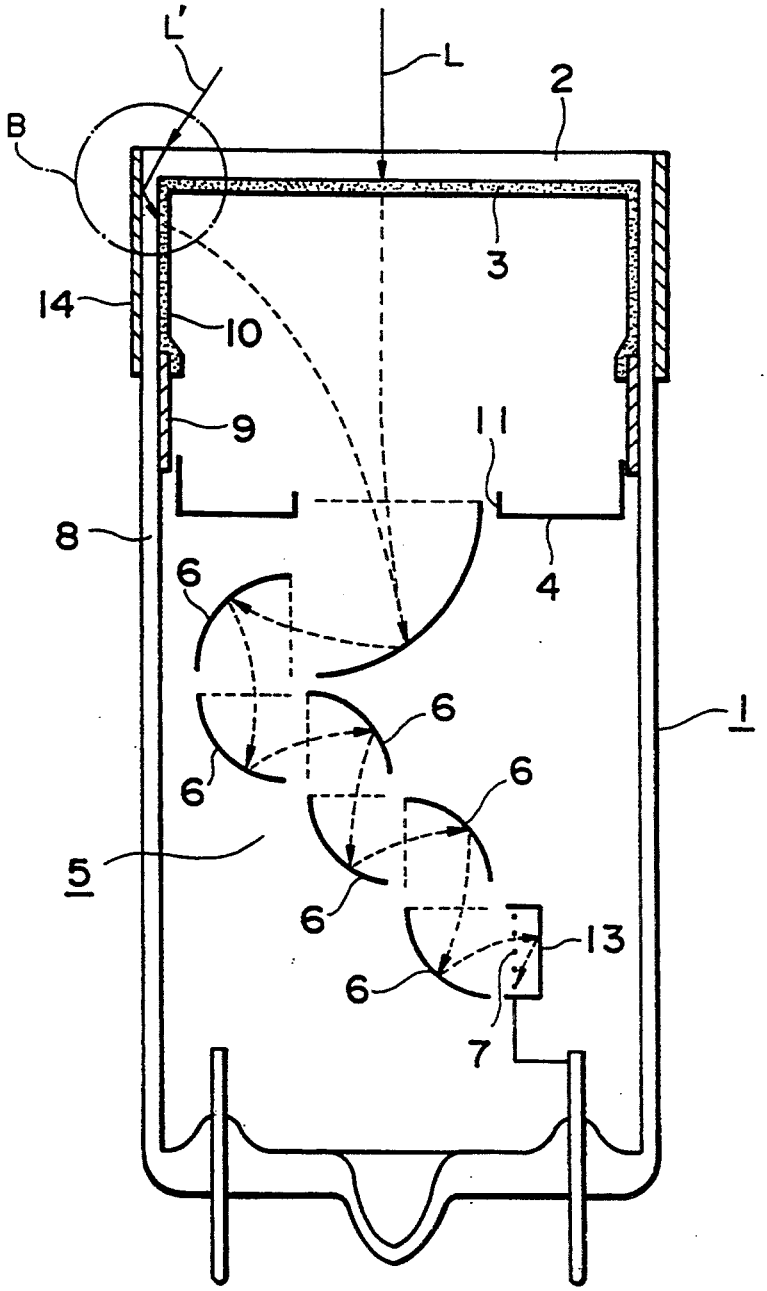
FIG. 4 is an end elevation schematically showing an embodiment of a photomultiplier according to the present invention.

FIG. 4 shows a photomultiplier of a so-called head-on type to which the present invention is applied. In FIG. 4, reference numeral 1 denotes a transparent tubular closed container. Specifically, the container is a transparent cylindrical glass bulb closed at the both ends. A light entrance window 2 is formed at the upper closed end of glass bulb 1. A photocathode (as will be referred to as "principal photocathode") 3 is formed inside the light entrance window 2.

The photocathode 3 is a film of photoemitter, which is made of antimony (Sb) and an alkali metal (for example cesium (Cs), potassium (K), rubidium (Rb), etc. ) or made (Te) and an alkali metal. As shown in FIG. 4, according to an embodiment of the present invention, the photoemitter film extends downward from the peripheral portion of the principal photocathode 3 and along the internal surface of side wall 8 of glass bulb 1. The downward extending portion of the photoemitter film terminates at a position substantially adjacent to the upper edge of aluminum vapor-deposited film 9. This downward extending portion of the photoemitter film also serves as a photocathode.

A focusing electrode 4 is disposed inside the glass bulb 1 at a position where it is opposed to the light entrance window 2. The focusing electrode 4 has an aperture 11, toward which photoelectrons emitted from the principal photocathode 3 are focused and through which the photoelectrons are guided to an electron multiplying unit 5.

Figure 5:
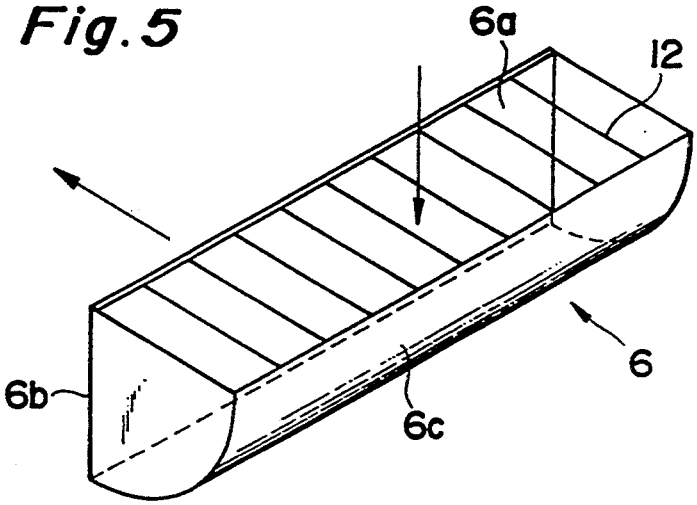
FIG. 5 is a perspective view showing a box-and-grid type dynode used in the photomultiplier of FIG. 4.

There are various types of electron multiplying units 5 which can be employed herein. This embodiment employs box-and-grid type dynodes 6 arranged in multiple stages. Each box-and-grid type dynode 6 is of quarter cylinder as shown in FIG. 5, a partition face 6*a* of which is an entrance plane of electrons and the other partition face 6*b* of which is an exit plane thereof. A grid 12 of fine wires are arranged in the entrance plane 6*a*. The electrons are surely guided into inside the dynode by this grid 12. Electrons entering the entrance plane 6*a* impinge on the internal surface of quarter-cylinder side wall 6*c*, whereby secondary electrons are emitted. The secondary electrons are released from the exit plane 6*b*. The thus released secondary electrons then enter next dynode 6. The secondary electrons successively multiplied are collected by a mesh anode 7 located at the front surface of plate dynode 13 in the final stage.

The peripheral portion of the principal photocathode 3 is extended by a predetermined length toward the focusing electrode 4 along the internal surface of side wall 8 of glass bulb 1. This extended portion constitutes a side photocathode 10 covering the entire upper internal surface of side wall 8. In this embodiment the lower edge of side photocathode 10 lies halfway between the principal photocathode 3 and the focusing electrode 4. In this arrangement, even photoelectrons emitted from the lowermost portion of side photocathode 10 can enter the electron multiplying unit 5 through the aperture 11 of focusing electrode 4. Also, the aluminum vapor-deposited film 9 for keeping the potential of photocathodes 3, 10 is formed over the entire internal surface of side wall 8 of glass bulb 1 in the region ranging from the lower edge of side photocathode 10 to a level of focusing electrode 4.

Further, a reflection film 14 with internal surface of reflective material is formed on a part of the external surface of glass bulb side wall 8 on the side of light entrance window 2, that is, on the upper portion of the outer surface such that it surrounds the entire side photocathode 10 while being opposed to the side photocathode 10. Preferably, the upper edge of reflection film 14 is located at the same level as the upper edge of the outer surface of side wall 8, and the lower edge of the film 14 is located slightly below the lower edge of side photocathode 10. The reflection film 14 may be formed by winding a reflective tape such as titanium oxide and aluminum around the side wall 8 of glass bulb 1, or by vapor-depositing aluminum or an equivalent on the side wall 8. Alternatively, the reflection film 14 may be formed by coating the side wall 8 with barium sulfate or an equivalent.

In the arrangement as described, when light L enters the central portion of light entrance window 2, the light L passes through the light entrance window 2 and then impinges on the principal photocathode 3, whereby photoelectrons are emitted. The photoelectrons are guided by the focusing electrode 4 to the electron multiplying unit 5 and successively multiplied in the electron multiplying unit 5 by the secondary emission effect. The electrons are finally collected by the anode 7. This operation is the same as that in the conventional structure.

Figure 6:
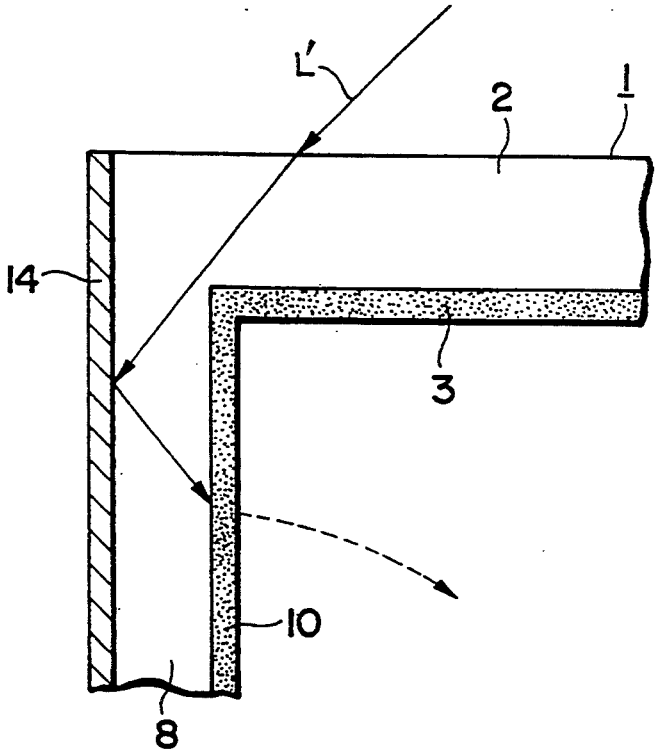
FIG. 6 is an enlarged view showing the portion B in FIG. 4 as enlarged.

If light L' enters the peripheral portion of light entrance window 2 obliquely and outwardly, the light L' advances in the side wall 8 of glass bulb 1 and is reflected by the reflective surface of reflection film 14, as shown in FIG. 6, which is an enlarged view of portion B in FIG. 4. This reflected light travels inwardly in the side wall 8 of glass bulb 1 and impinges on the side photocathode 10 formed on the internal surface of side wall. As a result, photoelectrons are emitted from the side photocathode 10. The photoelectrons are guided by the focusing electrode 4 to the electron multiplying unit 5 in the same manner as the light L and finally collected by the anode 7. In this manner the light L' entering the peripheral portion of light entrance window, which could not be detected in the conventional procedure, can also be detected in the present invention, whereby the sensitivity of photomultiplier can be improved.

Figure 3:
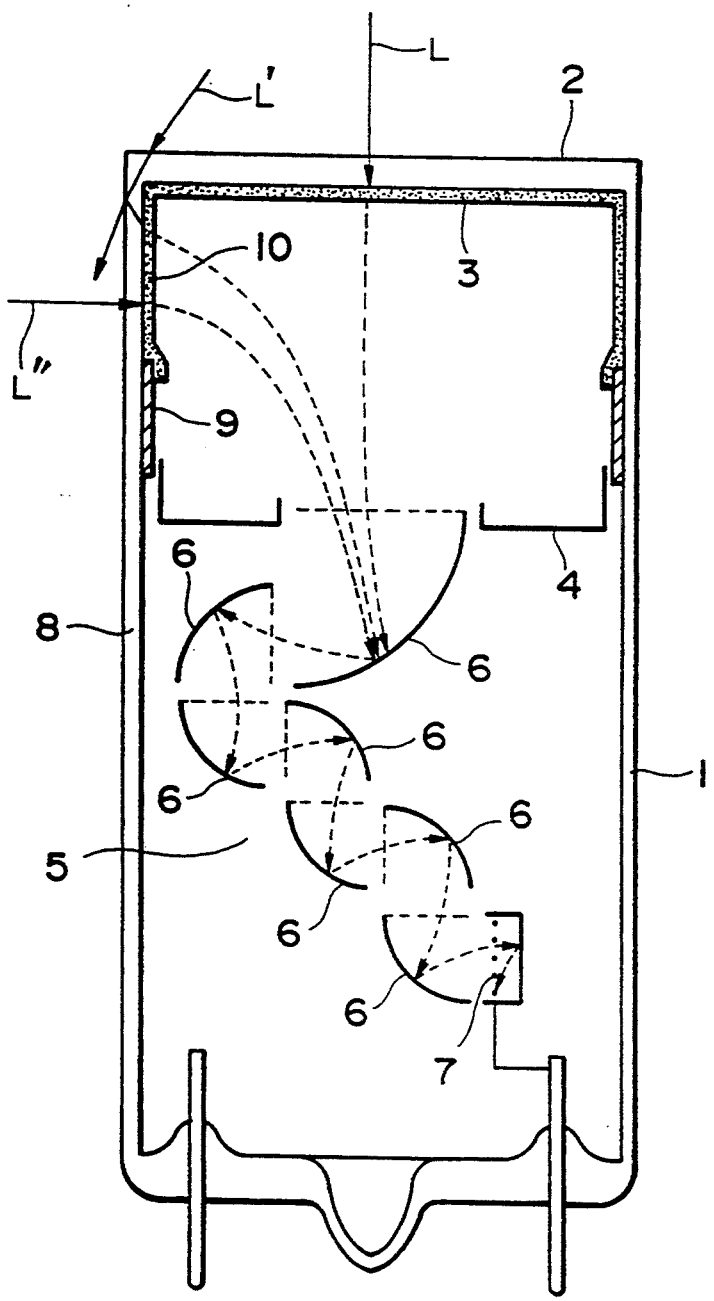
Fig. 3 (PRIOR ART)
FIG. 3 is an end elevation to schematically show another example of conventional photomultiplier.

Following Table 1 is a table of results of experiments in which cathode lumen sensitivities Sk are compared for each of a plurality of photomultipliers of the type shown in FIG. 1, different in size from each other, between samples with no reflection film and samples with reflection film formed on the outer surface of side wall of glass bulb. Also, Table 2 compares cathode lumen sensitivities of photomultipliers of the type shown in FIG. 3 different in size from each other with cathode lumen sensitivities of the photomultipliers with reflection film, that is, with cathode lumen sensitivities of photomultipliers according to the present invention.

TABLE 1

| No. | Without reflection film Sk (μA/lm) | With reflection film Sk (μA/lm) | Sensitivity up rate (%) |
|---|---|---|---|
| (1) | 172 | 173 | 0.58 |
| (2) | 158 | 158 | 0 |
| (3) | 190 | 191 | 0.53 |
| (4) | 175 | 175 | 0 |
| (5) | 162 | 161 | −0.62 |
| Average | 171.4 | 171.6 | 0.10 |

TABLE 2

| No. | Without reflection film Sk (μA/lm) | With reflection film Sk (μA/lm) | Sensitivity up rate (%) |
|---|---|---|---|
| (6) | 162 | 167 | 3.09 |
| (7) | 158 | 163 | 3.16 |
| (8) | 158 | 162 | 2.53 |

TABLE 2-continued

| No. | Without reflection film Sk (μA/lm) | With reflection film Sk (μA/lm) | Sensitivity up rate (%) |
|---|---|---|---|
| (9) | 153 | 157 | 2.61 |
| (10) | 145 | 150 | 3.44 |
| Average | 155.2 | 159.8 | 2.97 |

As seen from the above tables, the simple provision of reflection film 14 rarely improves the sensitivity of photomultipliers, but the combination of reflection film 14 with the side photocathode 10 can greatly improve the sensitivity.

According to the present invention, as described above, the photocathode is formed also on the internal surface of side wall in a head-on type photomultiplier and the reflection film is on the outer surface of the side wall as surrounding the side photocathode, whereby incident light into the peripheral portion of light entrance window, which leaked out in the conventional procedure, can be guided to impinge on the photocathode so as to enlarge the effective area of photocathode. Accordingly, even with photomultiplier of the same size, a quantity of detected light increases as compared with those in the conventional structures, whereby the sensitivity of photomultiplier can be greatly improved.

There are of course various modifications to the above embodiments in the present invention. For example, the reflection film 14 is formed over the entire circumference on the outer surface of side wall 8 of glass bulb 1 in the above embodiment, but the reflection film 14 may be partially omitted if desired. Accordingly, all modifications within the true spirit and scope of the invention are included in the scope of this disclosure.

What is claimed is:

1. A photomultiplier comprising:

container having first and second ends, a side wall, and internal and outer surfaces;

a photocathode formed on said internal surface of said first end of said container;

an electron multiplying unit provided in said container, said electron multiplying unit being constructed and arranged for receiving light entering said first end and for multiplying electrons emitted from said photocathode;

a focusing electrode having an aperture for focusing said electrons emitted from said photocathode and for guiding said electrons to said electron multiplying unit, said focusing electrode being disposed between said photocathode and said electron multiplying unit;

a side photocathode formed along said internal surface of said side wall of said container in a predetermined region, said predetermined region being positioned adjacent to said photocathode; and a reflection film formed on said outer surface of said side wall of said container, said reflection film having a reflective surface that faces and substantially opposes said side photocathode.

2. A photomultiplier according to claim 1, wherein said side photocathode extends from a peripheral edge of said photocathode to a predetermined level located between said focusing electrode and said photocathode, said side photocathode being constructed and arranged for allowing said electrons emitted from said side photocathode to be guided to said electron multiplying unit through said aperture of said focusing electrode.

3. A photomultiplier according to claim 2, wherein said reflection film extends from said first end to a position located between said predetermined level and said second end.

4. A photomultiplier according to claim 3 further comprising a second reflection film formed along said internal surface of said side wall of said container, said second reflection film having a first end positioned substantially adjacent to said predetermined level and a second end extending towards said second end of said container.

5. A photomultiplier according to claim 4, wherein said container is a transparent tubular closed container.

6. A photomultiplier according to claim 3, wherein said container is a transparent tubular closed container.

7. A photomultiplier according to claim 2 further comprising a second reflection film formed along said internal surface of said side wall of said container, said second reflection film having a first end positioned substantially adjacent to said predetermined level and a second end extending towards said second end of said container.

8. A photomultiplier according to claim 7, wherein said container is a transparent tubular closed container.

9. A photomultiplier according to claim 2, wherein said container is a transparent tubular closed container.

10. A photomultiplier according to claim 1, wherein said reflection film is formed by winding a reflective tape having a reflective surface on an adhesive face thereof around the outer surface of said side wall of said closed container.

11. A photomultiplier according to claim 1, wherein said reflection film is formed by vapor-depositing aluminum or an equivalent over the outer surface of said side wall of said closed container.

12. A photomultiplier according to claim 1, wherein said reflection film is formed by coating the outer surface of said side wall of said closed container with barium sulfate or an equivalent.

13. A photomultiplier according to claim 1, wherein said container is a transparent tubular closed container.

* * * * *